United States Patent [19]

Peterson, Jr.

[11] 4,127,117

[45] Nov. 28, 1978

[54] PORTABLE HYDROTHERAPY BATH ASSEMBLY

[75] Inventor: Samuel F. Peterson, Jr., Chicago, Ill.

[73] Assignee: Associated Mills, Inc., Chicago, Ill.

[21] Appl. No.: 815,491

[22] Filed: Jul. 14, 1977

[51] Int. Cl.[2] ..... A61H 9/00

[52] U.S. Cl. ..... 128/66; 4/178

[58] Field of Search ..... 128/66; 4/178, 180

[56] References Cited

U.S. PATENT DOCUMENTS

| | | | |
|---|---|---|---|
| 2,559,678 | 7/1951 | Schroeter | 128/66 |
| 3,674,020 | 7/1972 | Jacuzzi | 128/66 |
| 3,842,823 | 10/1974 | Jacuzzi et al. | 128/66 |
| 3,846,848 | 11/1974 | McNair | 4/180 |
| 3,961,382 | 6/1976 | Peterson | 4/178 |

FOREIGN PATENT DOCUMENTS

| | | | |
|---|---|---|---|
| 553,767 | 1/1957 | Belgium | 128/66 |

*Primary Examiner*—Lawrence W. Trapp

*Attorney, Agent, or Firm*—Allegretti, Newitt, Witcoff & McAndrews

[57] ABSTRACT

The improved portable hydrotherapy bath assembly disclosed is designed for mounting on the side wall of a conventional bathtub and includes a motor housing, an overhead support housing and a pump housing. The motor, pump and overhead support housings are made as a single integral unit with their upper ends being closed by a cover. The motor housing is adapted to be disposed without the bathtub, the overhead support housing is adapted to rest on the tub side wall and pump housing is adapted to be disposed within the tub, with its lower end adapted to be immersed within the water in the tub.

A pumping chamber is mounted on the lower end of the pump housing and includes an impeller means whose drive shaft is perpendicular to the longitudinal axis of the pump housing. An electric motor is mounted within the motor housing and is directly operatively connected with a rotary shaft journaled in the overhead support housing. Pulleys are mounted on this rotary shaft and on the drive shaft of the impeller means, and an endless belt operatively connects the pulleys.

The pumping chamber includes horizontally disposed, diametrically oppositely directed first and second discharge ports. A unique rotary valve member is positioned within the pumping chamber for selectively controlling the discharge of water, under pressure, through either the first discharge port or the second discharge port. The rotary valve is actuated by a control knob mounted on the side wall of the pump housing facing away from the side wall of the bathtub. The axes about which the rotary valve and control knob are rotated are coaxial with the longitudinal axis of the drive shaft of the impeller means.

10 Claims, 10 Drawing Figures

PORTABLE HYDROTHERAPY BATH ASSEMBLY

BACKGROUND OF THE INVENTION

The present invention relates to an improved portable hydrotherapy or whirlpool bath assembly of the type designed to be mounted on the side wall of a conventional bathtub and to be used to create a relaxing, soothing swirling or whirlpool effect in the water in the bathtub.

Hydrotherapy or whirlpool bath assemblies have long been used. Generally prior hydrotherapy bath assemblies, like the assembly disclosed in my U.S. Pat. No. 3,961,393, have included a motor housing, a pump housing and overhead support housing which interconnects the upper ends of the motor and pump housing so that the bath assemblies have inverted U-shaped configuration.

Conventionally, the motor housing is disposed on the outside of the bathtub, the pump housing is disposed within the bathtub, with its lower end immersed in the water in the tub, and the bottom wall of the overhead support housing rests on the upper edge of the tube side wall. A pumping chamber, including an impeller means, is mounted at the lower end of the pump housing, with the drive shaft of the impeller means extending vertically upwardly so that its distal end is adjacent to the upper end of the pump housing. An electric motor is mounted in the motor housing and is utilized to drive the upper end of the impeller shaft by means of a pair of pulleys and an endless belt disposed within the overhead support housing. During the operation of the prior hydrotherapy bath assemblies, rotation of the impeller means within the pumping chamber resulted in a relaxing soothing stream of water being emitted under pressure, from the pumping chamber, and a person in the tub could immerse himself in the resulting swirling water so as to enjoy the beneficial effect thereof.

While the prior hydrotherapy bath assemblies have generally performed their intended function satisfactorily, they have tended to be relatively heavy and rather bulky. The weight of the prior hydrotherapy bath assemblies has limited, as a practical matter, those who are able to mount and dismount the prior hydrotherapy bath assemblies on and off a bathtub. Moreover, the pump housings utilized with the prior hydrotherapy bath assemblies have had, by necessity, to have a relatively large cross-sectional area because of the need to accommodate within this housing the bearings and other structure required to support and seal the vertical impeller drive shaft as well as the pumping chamber. Thus the pump housings of the prior hydrotherapy bath assemblies have frequently occupied quite a bit of space in the bathtub and have often projected quite far into the interior of the bathtub from the side wall of the tub. In addition, when it was desired to change the direction of the water being discharged from the pumping chamber, the entire pump housing would have to be turned about its vertical, longitudinal axis. Because of its weight and size, this turning of the pump housing has tended to be a somewhat awkward and sometimes quite difficult maneuver, particularly for someone outside of the tub.

SUMMARY OF THE INVENTION

It is important object of the present invention to provide an improved portable hydrotherapy bath assembly which is relatively light-weight, which is compact, particularly with respect to the pump housing that is designed so as to occupy minimal room in the bathtub, and which may be relatively easily mounted on and dismounted from a bathtub by persons, such as senior citizens, who sometimes have less than average strength and agility. A related object of the present invention is to provide an improved portable hydrotherapy bath assembly of the type described wherein the direction of the water being discharged, under pressure, from the pumping chamber may be changed by rotating a control knob rather than by having to turn the entire pump housing.

More specifically, the improved portable hydrotherapy bath assembly of my present invention includes a motor housing adapted to be disposed on the outside of the bathtub so that it is adjacent to the side wall of the tub, a pump housing adapted to be disposed within the bathtub so that it is adjacent to the side wall of the tub, with its lower end immersed in the water in the tub, and an overhead support assembly adapted to rest on the upper edge of the tub. The upper ends of the motor and pump housing are connected with the ends of the overhead support housing so that my improved portable hydrotherapy bath assembly has a generally inverted U-shaped configuration. The motor, pump and overhead support housings are preferably formed as a single, integrally molded unit and a cover member overlies and closes the upper ends of these housing.

A pumping chamber, including an impeller, is mounted on the pump housing adjacent to its lower end. For the purpose of making the pump housing of my improved hydrotherapy bath assembly as compact as possible, i.e. to minimize the amount of space occupied in the bathtub by the pump housing and to minimize the distance that the pump housing projects out into the bathtub from the side wall of the tub, the pumping chamber is mounted on the side wall of the pump housing so that the axis of the drive shaft of the impeller is disposed in a horizontal plane. A rotary shaft is journaled in the overhead support housing and is arranged so as to be parallel with the longitudinal axis of the overhead support housing and with the longitudinal axis of the impeller drive shaft. One end of this rotary shaft is operably connect with an electric motor mounted in the motor housing so that the longitudinal axis of its output shaft is coaxial with the longitudinal axis of the rotary shaft. The other end of the rotary shaft is operably connected, by means of pulleys and an endless belt, with the drive shaft of the impeller. Because this pulley and belt arrangement requires only a minimal "thickness", in a direction perpendicular to the plane in which the belt moves, this arrangement can be disposed immediately adjacent to the tub side wall so that the entire pump housing need only have a relatively small "thickness" and cross-sectional area.

Because of the unique structure and structure arrangement of the improved portable hydrotherapy bath assembly of the present invention, a much smaller, and thus lighter, electric motor may be utilized to power the assembly without significantly affecting the swirling, soothing and relaxing effect produced by the assembly. Hence the overall weight of my improved portable hydrotherapy bath assembly is appreciably less than prior comparable hydrotherapy bath assemblies.

The pumping chamber includes two discharge ports which are disposed horizontally in a plane perpendicular to the axis of the drive shaft of the impeller and which are diametrically oppositely directed. A unique rotary valve is mounted on the pumping chamber and selectively determines whether water, under pressure, will be discharged from one or the other of the discharge ports, as well as serving to define the chamber in which impeller rotates. The rotary valve is actuated by a rotary control knob which is mounted on the pumping chamber so that the rotary axes of the valve and the knob are coaxial with the longitudinal axis of the drive shaft of the impeller and so that the control knob may easily be manipulated by a person from within the bathtub.

These and other advantages of my present invention will become apparent from the foregoing description of the preferred embodiment of my inventon, described in connection with the accompanying drawings.

Figure 1:
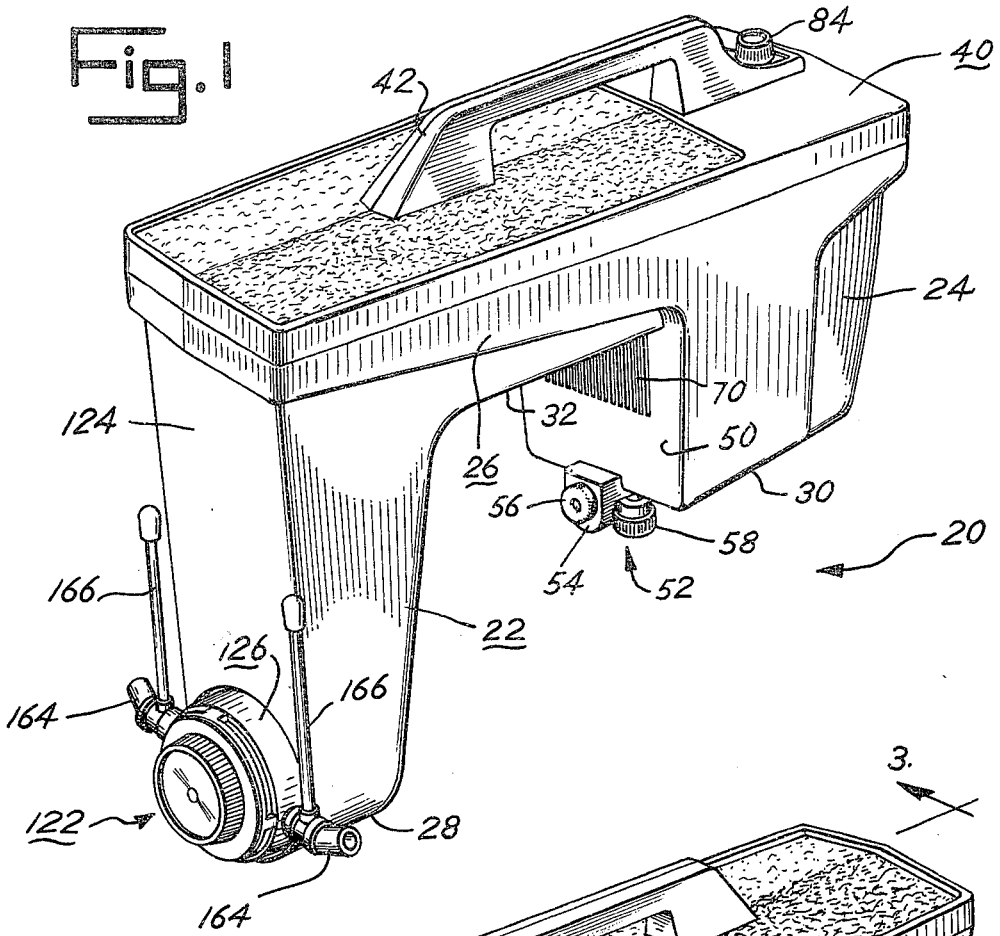
FIG. 1 is a perspective view of a portable hydrotherapy bath assembly of my present invention, with the pump housing being shown in the foreground.

Throughout the various figures of the drawings, the same reference numerals will be used to designate the same parts. Moreover when the terms "right, "left", "right end", "left end", "up" and "down" are used herein, it is to be understood that these terms have reference to the structure as shown in the drawings as it would appear to a person viewing the drawings.

DESCRIPTION OF THE PREFERRED EMBODIMENT

Figure 2:
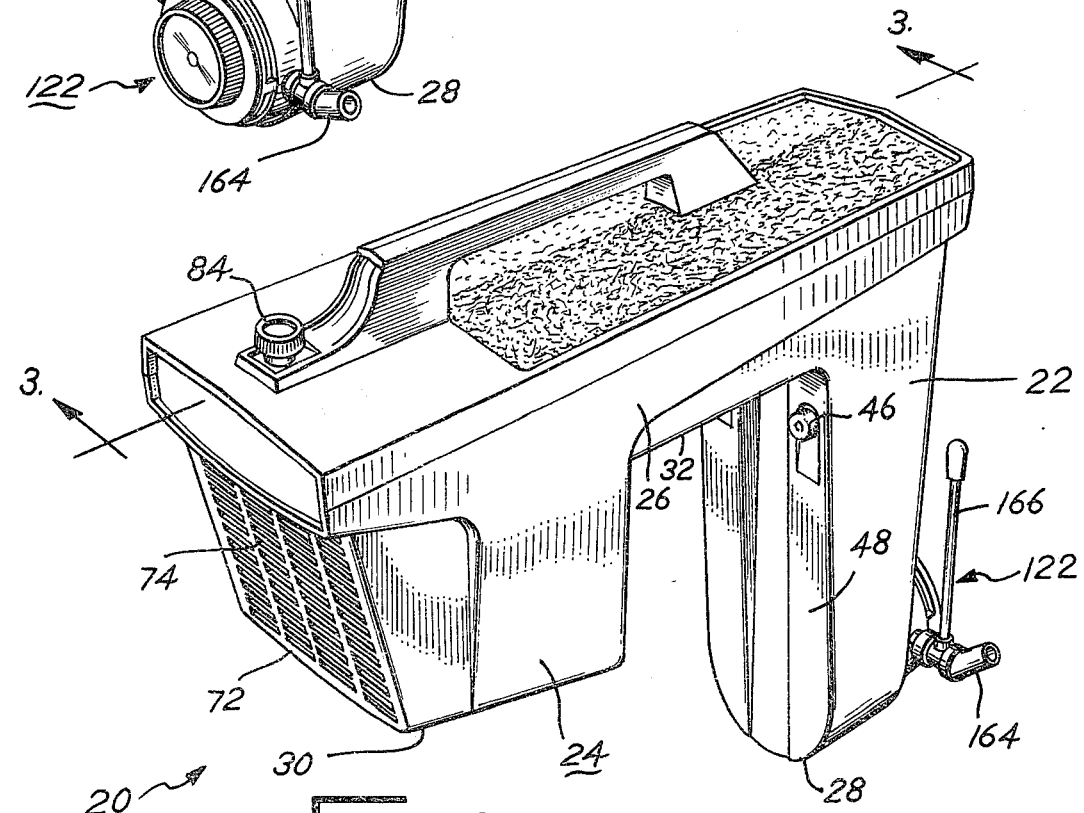
FIG. 2 is a perspective view of the improved portable hydrotherapy bath assembly shown in FIG. 1, with the motor housing being shown in the foreground.
Figure 3:
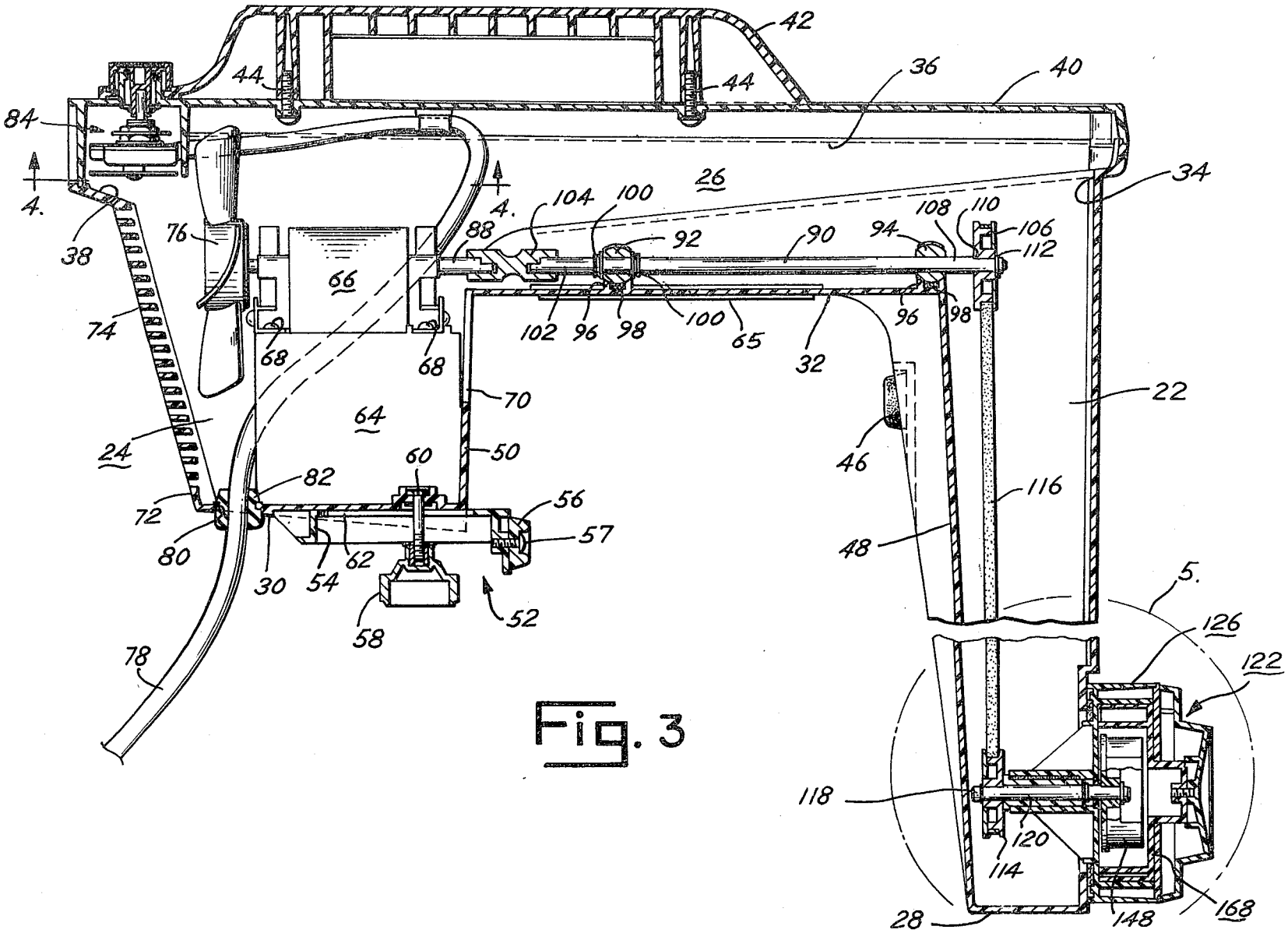
FIG. 3 is a vertical cross-sectional view taken along the line 3—3 of FIG. 2.

Referring now to FIGS. 1-3, an improved portable hydrotherapy bath assembly embodying the principles of my present invention is shown generally at 20 and includes a pump housing 22, a motor housing 24 and an overhead support housing 26. The housings 22, 24 and 26 are molded as a single integral unit from a plastic material, and except as otherwise noted, the lower ends 28 and 30 of the pump and motor housings 22 and 24, respectively, and the bottom wall 32 of the overhead support housing 26 are closed so as to be water tight. A cover 40 overlies and completely closes the upper open ends 34, 36 and 38 of the housings 22, 24 and 26, respectively. The cover 40 includes a separable handle 42 which is molded from a plastic material and which is secured to the cover 40 by a plurality of screws 44, as best seen in FIG. 3.

The hydrotherapy bath assembly 20 is designed to be mounted on the side wall of a conventional bathtub, not shown. More specifically, the bath assembly 20 is adapted to be mounted on a tub side wall so that the pump housing 22 is disposed within the tub adjacent to the tub side wall, with its lower end 28 immersed in the water in the tub, so that the motor housing 24 is disposed without the tub adjacent to the side wall of the tub and so that the bottom wall 32 of the overhead support housing 26 rests on the upper edge of the tub side wall.

A pair of resilient "bumper" members 46 are secured to side wall 48 of the pump housing 22, i.e. to its side wall adjacent to the tub side wall, and are designed to contact the adjacent tub side wall when the hydrotherapy bath assembly 20 is mounted on the bathtub. A side wall 50 of the motor housing 24 is adapted to be positioned adjacent to but not in direct contact with the tub side wall when the hydrotherapy bath assembly 20 is mounted on the tub. In this regard, an adjustable clamp assembly 52, supported on the lower end 30 of the motor housing 24, is utilized to bear against the surface of the tub side wall adjacent to the motor housing 24 and thus urge the bumper members 46 against the opposite surface of the tub side wall. This clamp assembly 52 includes a slide member 54 having a resilient "bumper" member 56 secured, by a screw 57 to its one, tub side wall facing end. A knob 58 is threaded on the end of a bolt 60 which extends through the lower end 30 and through a longitudinal slot 62 formed in the slide member 54. The knob 58 is used to clamp and hold the slide member 54 in a position wherein its bumper member 56 is in direct contact with the adjacent surface of the tub side wall. The bottom wall 32 of the overhead support housing 36 includes strips of a non-abrasive pad 64 so as to assure that the hydrotherapy bath assembly 20 will not scratch the surface of the upper edge of the tub side wall when the bath assembly 20 is mounted thereon.

Referring now to FIG. 3, the motor housing 24 includes a pair of integrally molded rails 64 which project upwardly within the housing 24 from its lower end 30, and form a support for a conventional electric motor 66 secured to the rails 64 by a plurality of bolts 68. The side wall 50 includes a plurality of slots 70 while the other side wall 72 of the housing 24 includes an open grill 74. The slots 70 and grill 74 are arranged so that there is a proper cross-ventilation air flow through the motor housing and across the electric motor 66. A fan 76 is mounted on the end of the electric motor 66 facing the grill 74 and operates each time the motor 66 runs so as to assure proper cooling for the motor 66 by providing a sufficient air flow across the motor while it is running.

Figure 4:
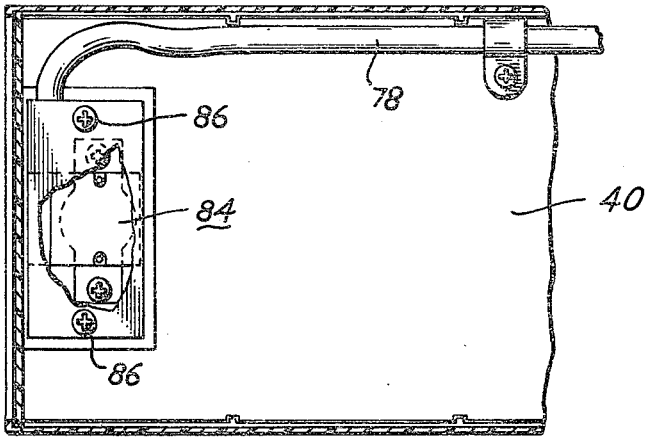
FIG. 4 is a vertical cross-sectional view taken along the line 4—4 in FIG. 3.

The electric motor 66 is connected with a conventional source of electrical power by means of a standard electric cord 78. The cord 78 passes out of the motor housing 24 through an aperture 80 which is formed in the lower end 30 and which is sealed by a gromment 82. A conventional off/on switch 84 is mounted in the portion of the cover 40 which overlies the motor housing 24 and controls the operation of the electric motor 66. As best shown in FIG. 4, the switch 84 is mounted on the cover 40 by a plurality of screws 86.

As illustrated in FIG. 3, the electric motor 66 has rotary output shaft 88, and the motor 66 positioned and arranged on the rails 64 so that the longitudinal axis of the shaft 88 is substantially parallel to the longitudinal axis of the overhead support housing 26 and is adjacent to the bottom wall 32 of the housing 26. A shaft 90 is mounted for rotation about its longitudinal axis on the bottom wall 32 of the overhead support housing 26. The longitudinal axis of the shaft 90 is parallel with the longitudinal axis of the overhead support housing 26 and is coaxial with the longitudinal axis of the shaft 88. A pair of conventional self-aligned, porous bronze bearings 92 and 94 support the shaft 90 for rotation and are mounted in bearing support members 96 integrally molded in the bottom wall 32. Each of these bearing support structures 96 includes a recess for receiving and retaining a conventional oil wick pads 98. Conventional "E" clips and spring washers 100 are positioned about the shaft 90 adjacent to both sides of the bearing 92 so as to take up any end play in the shaft 90.

The distal or right hand end of the shaft 88 is connected with the adjacent or left hand end 102 of the shaft 90 by means of a pliant, non-electrically conductive member 104 which is disposed within slots, not shown, formed in the adjacent ends of the shafts 88 and 90. The member 104 has a relatively thin generally rectangular configuration and has a cutaway portion adjacent its central section. The member 104 is designed and constructed so that the shaft 90 will rotate in response to rotation of the shaft 88, i.e. in response to the operation of the electric motor 66, and so that it will accommodate misalignments between the right hand end of the shaft 88 and the left hand end 102 of the shaft 90. The member 104 is also designed and constructed so that it will rupture or break if for some reason the shafts 88 and 90 are exposed to a sudden shock or stress during the transmission of power from the electric motor 66 to the shaft 90 so as to minimize the damage that might otherwise occur to the components of the assembly 20 due to such a shock or stress.

A pulley 106 is mounted on the other or right end 108 of the shaft 90 between a shoulder 110 and a clip 112 and is adapted to rotate with the shaft 90. The pulley 106 overlies the upper end 34 of the pump housing 22 and is adjacent to the side wall 48 of that housing. The pulley 106 is operatively connected with and is adapted to drive a second pulley 114 by means of a conventional endless, non-slip clog belt 116. As hereinafter described in more detail, the pulley 114 is mounted on the distal or left hand end 118 of a drive shaft 120.

Figure 5:
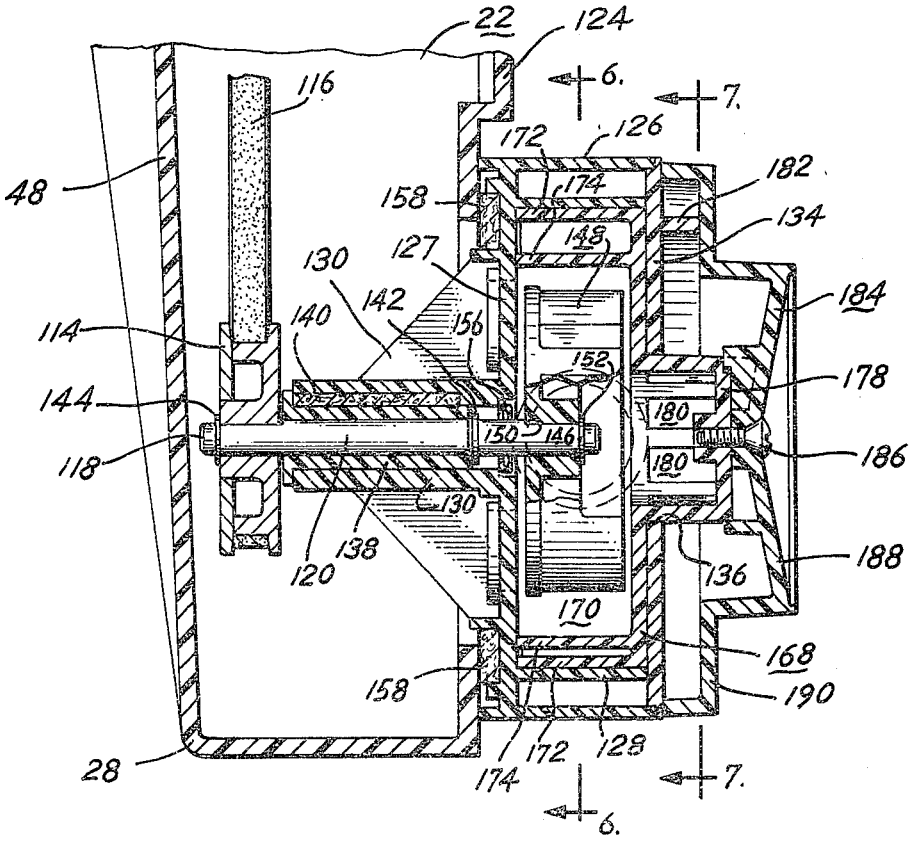
FIG. 5 is an enlarged, detailed view of the lower end of the pump housing taken along the line 5—5 in FIG. 3.
Figure 6:
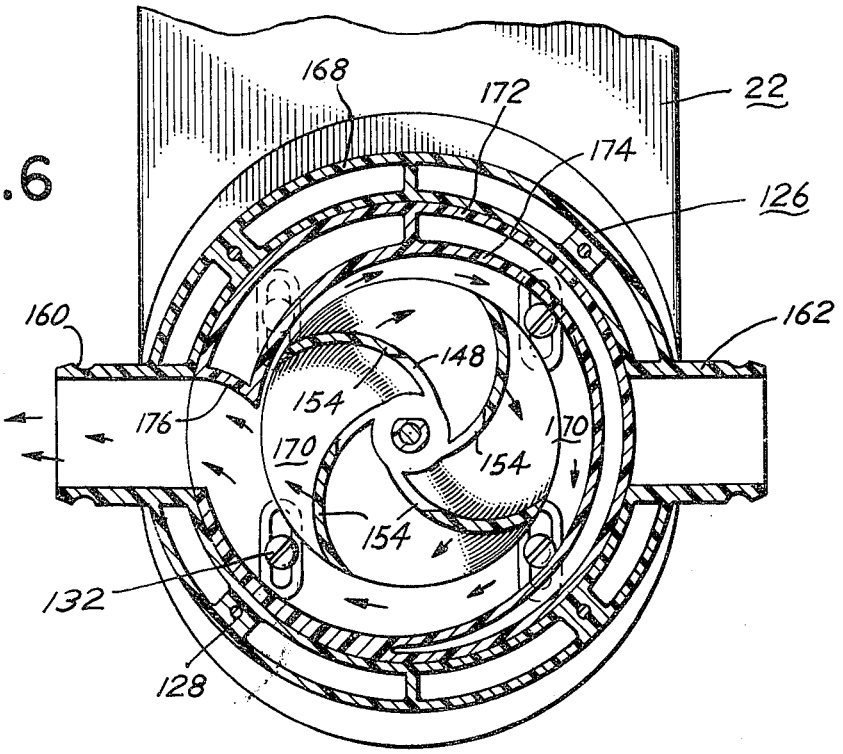
FIG. 6 is a cross-sectional view taken along the line 6—6 in FIG. 5.
Figure 7:
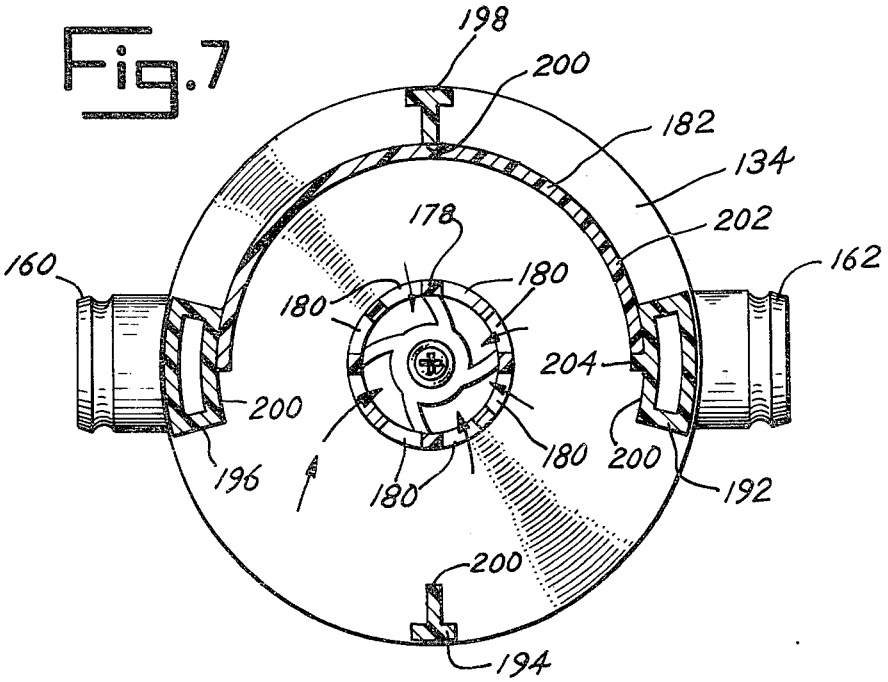
FIG. 7 is a cross-sectional view taken along the line 7—7 in FIG. 5.
Figure 8:
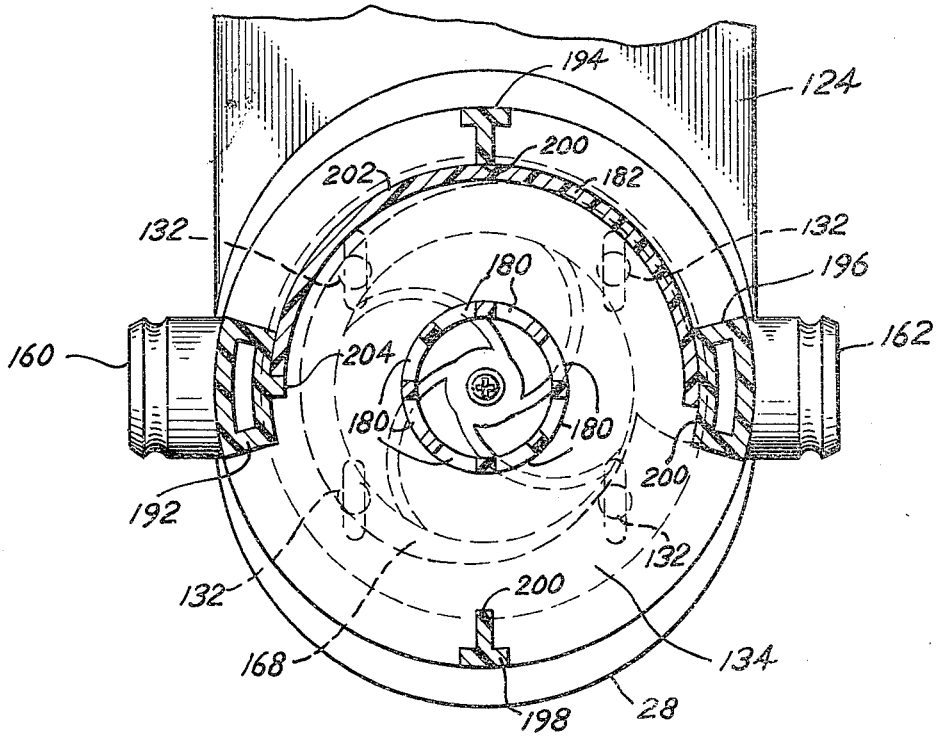
FIG. 8 is a cross-sectional view similar to that shown in FIG. 7 except that the control knob has been rotated through an arc of 180°.

Referring now to FIGS. 3 and 5–10, a pumping chamber, generally shown at 122, is mounted on the outer surface of the pump housing side wall 124, that faces away from the tub side wall, adjacent to the lower end 28 of the pump housing 22. The pumping chamber 122 includes a stationary housing 126 which comprises a base 127, an annular wall portion 128, and a rearwardly or leftwardly projecting shaft support portion 130. As best shown in FIGS. 6 and 8, four screws 132 secure the base 127, and thus the housing 126, to the side wall 124. A plate 134, having a central aperature 136 therein, overlies and closes the outwardly or rightwardly facing end of the housing 126 and is secured to the wall portion 128 of the housing 126 by a plurality of screws, not shown.

The shaft support portion 130 of the housing 126 receives and holds a conventional tubular, porous bronze bearing 138 together with a conventional non-slip felt oil wick pad 140. The shaft 120 is journaled for rotation in the bearing 138 and a conventional clip 142 on the shaft 120 holds the bearing 138 longitudinally against the right face of the pulley 114. A second clip 144 is mounted on the left end 118 of the shaft 120, adjacent to the left side of the pulley 114, so as to maintain the pulley 114 on the shaft 120 and in a proper relationship with respect to the bearing 138.

The other or right hand end 146 of the shaft 120 has an impeller 148 which is mounted thereon by means of a shoulder 150 and a clip 152 and which is disposed within the chamber, defined by the base 127, the wall portion 128 and the plate 134, for rotation therein as a result of rotation of the shaft 120. The impeller 148 includes a plurality of blades 154 and is of conventional design and construction.

A conventional shaft seal 156 is disposed about the shaft 120 adjacent to the juncture of the base 127 and support portion 130 of the housing 126 and prevents leakage of water along the periphery of the shaft 120 between the shaft 120 and the bearing 138. Since the pumping chamber 122 is designed to be immersed in the water in the bathtub, a conventional seal 158 is also disposed between the housing 126 and the adjacent side wall 124 so as to prevent water from leaking between the housing and the side wall and into the interior of the pump housing 22. The wall portion 128 of the housing 126 includes two integral, diametrically oppositely directed ports 160 and 162 for permitting water to flow from within the housing 126 to the exterior of the pumping chamber 122. The longitudinal axes of the discharge ports 160 and 162 are coaxial, intersect the central longitudinal axis of the shaft 120 and are horizontally disposed when the hydrotherapy bath assembly 20 is properly positioned on a tub side wall. Conventional nozzles and aerators, shown generally at 164 and 166, respectively, in FIGS. 1 and 2, may be snap-fitted onto the projecting ends of the discharge ports 160 and 162 although in FIGS. 3–10, these nozzles and aerators have been omitted for clarity.

Figure 10:
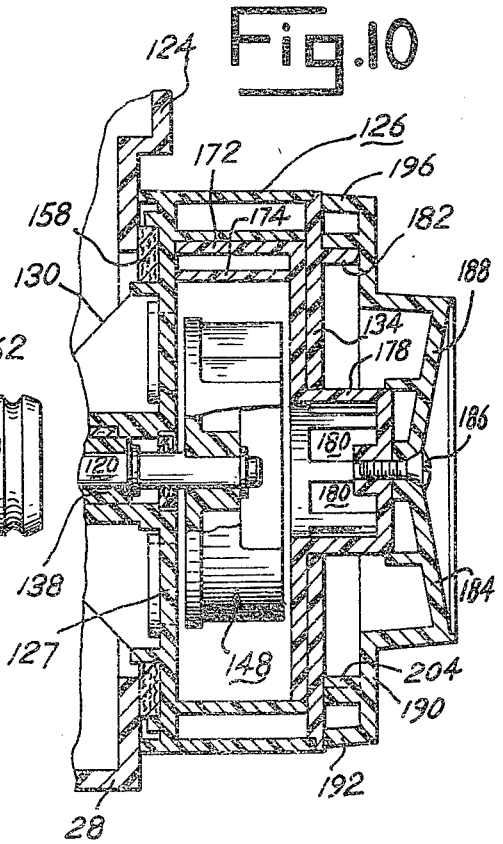
FIG. 10 is a cross-sectional view taken along the line 10—10 in FIG. 9.

As best illustrated in FIGS. 5, 6 and 10, a member 168 is generally disposed within a chamber 170 defined by the base 127, the wall portion 128 and the plate 134. The member 168 cooperates with the chamber 170 and with the impeller 148 so as to permit the impeller and chamber to perform as a pump and so as to determine through which of the two discharge ports 160 and 162 water, under pressure, will be discharged during the operation of the hydrotherapy bath assembly 20. More specifically, the member 168 includes a unitary generally circular, outer wall 172 and a convolutedly curved inner wall 174 which defines a pumping cavity within the chamber 170. The walls 172 and 174 are continuous except for a port 176 which has a circumferential dimension substantially equal to the diameter of the discharge ports 160 and 162 and which permits water to flow from the chamber 170 to and through the discharge ports. The radially outwardly facing surface of the outer wall 172 has substantially the same diameter as that of the radially inwardly facing surface of the wall portion 128 so that the member 168 fits snugly within the chamber 170 and so that there is a surface to surface contact between the outer wall 172 and the wall portion 128 except for in the area of the port 176. In spite of the snug fit between the outer wall 172 and the wall portion 128 in the chamber 170, the member 168 may be manually rotated within the chamber 170 about an axis coaxial with the longitudinal axes of the shaft 120 and of the housing 126. As noted above, the inner wall 174 of the member 168 has a convoluted shape and cooperates with the impeller 148 to define a pumping cavity so that rotation of the impeller causes water to be pumped, under pressure, from the chamber 170 through whichever discharge port 160 or 162 is then aligned with the port 176.

The member 168 also includes an integral center cage portion 178 that is connected with the walls 172 and 174 and that projects to the right through the central aperature 136 in the plate 134. Openings 180 defined by the cage portion 178 permits water to be drawn into the pumping cavity adjacent to the center of the impeller 148 and serve as the water inlet for the pumping chamber 122.

An arc shaped flange 182 is integrally formed on and projects outwardly from the right hand facing surface of the plate 134. This flange 182 extends through an arc of about 120°, and overlies the upwardly facing openings 180 formed in the cage portion 178 of the member 168. The flange 182 tends to restrict the flow of water into the openings 180 in the cage portion 178 from above the cage portion so as to avoid cavitation problems that might occur if water, and perhaps air, were freely drawn into the openings 180 from above the cage portion.

A control knob 184 is secured, by means of a screw 186, to the center of the right end of the cage portion 178 so that rotation of the knob 184, about an axis coaxial with the longitudinal axis of the shaft 120, causes corresponding rotation of the cage portion 178 and thus of the member 168 within the chamber 170. The knob 184 includes a central portion 188 whose annular, radially outwardly facing surface includes a plurality of ribs, not shown, to facilitate gripping the knob. The knob 184 also includes an integral, annular flange portion 190 which extends radially outwardly from the central portion 188, with the outer diameter of this flange portion being substantially the same as that of the plate 134.

Adjacent its outer periphery of the flange portion 190, the knob 184 has four integral projections 192, 194, 196 and 198 that project to the left from the plane of the flange portion 190. These projections are disposed about the periphery of the flange portion 190 at 90° intervals and extend inwardly or to the left so as to overlie the flange 182. The radially inwardly facing surfaces 200 of these projections are curved and are spaced from the center, rotational axes of the knob 184 so when the knob 184 is rotated with respect to the plate 134, these surfaces 200 pass closely adjacent to the radially outwardly facing surface 202 of the flange 182.

A tab 204 informed on the surface 200 of the projection 192 and projects radially inwardly from the surface 200 a sufficient distance so that the leading and trailing edges of the flange 182 will strike the tab 204 whenever the flange 182 and the projection 192 are adjacent due to rotation of the knob 184 with respect to the housing 126 and thus with respect to the plate 134 and flange 182. In other words, the tab 204 serves as a stop with respect to rotation of the knob 184 in either the clockwise or counterclockwise direction.

As noted above, the control knob 184 is secured to the cage portion 178 so that no relative rotational movement can occur therebetween. Thus rotation of the control knob 184 will cause rotation of the member 186 with respect to the housing 126. As shown in FIG. 7, when the tab 204 abuts one edge of the flange 182, due to rotation of the knob 184 in a clockwise direction, the member 168 is positioned so that the port 174 permits communication between the discharge port 160 and the interior of the chamber 170 while blocking communication between the discharge port 162 and the chamber 170. Similarly as generally shown in FIG. 8, when the tab 204 abuts the other end of the flange 182, due to rotation of the knob in the counterclockwise direction, the member 168 has been rotated so that the port 174 now permits communication between the discharge port 162 and the chamber 170 while blocking communication between the discharge port 160 and the chamber 170. Thus by the simple expedient of rotating the control knob 184, a user of the hydrotherapy bath assembly 20 may select through which of the two discharge ports 160 and 162 water, under pressure, is to be discharged.

Figure 9:
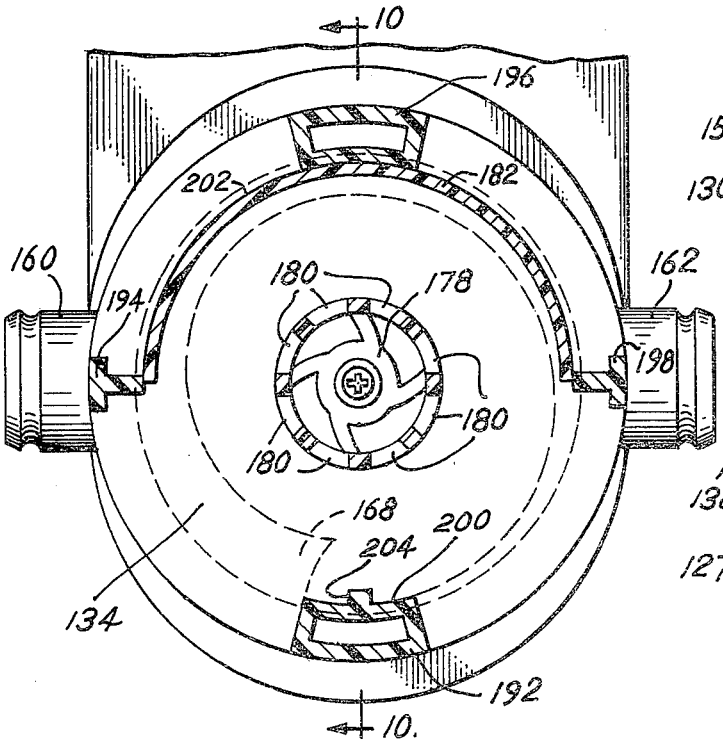
FIG. 9 is a cross-sectional view similar to that shown in FIGS. 7 and 8 except that the control knob is shown in a position midway between the positions which it is shown in FIGS. 7 and 8.

As also noted above, the hydrotherapy bath assembly 20 is designed to be mounted on the side wall of a bathtub with its pump housing 22 being disposed within the tub, with its motor housing 24 being disposed without the tub and with the bottom wall 32 of its overhead support housing 26 resting on the upper edge of the tub side wall. For best performance the lower end 28 of the pump housing 22 must be immersed in the water in the tub so that the pumping chamber 122 is completely covered by water. The hydrotherapy bath assembly 20 may be operated by turning on the on/off switch 84. During operation of the assembly 20, the electric motor 66 causes the shaft 90 to rotate, and this, in turn, causes the shaft 120 to rotate as a result of the pulleys 106 and 144 and their associated endless belt 116. Rotation of the shaft 120 causes corresponding rotation of the impeller 148 within the chamber 170. Such rotation of the impeller causes water to be drawn into the chamber 170 through the openings 180 in the cage portion 178 and to be discharged, under pressure, from the chamber 170 through either the discharge port 160 or the discharge port 162. Whether the water is discharged from the port 160 or the port 162, depends on the position of the control knob 184 with respect to the housing 126. In other words, rotation of the control knob 184 causes the member 168 to rotate within the housing 126, and it is the position of the member 168, vis-a-vis the housing 126, which determines whether the water, under pressure, will be discharged from the port 160 or the port 162 or whether, as best shown in FIG. 9, neither of these ports 160 or 162 is in communication with the chamber 170 so that no water is being discharged from the chamber 170.

The use of the shaft 90 in the overhead support housing 126 and the pulleys 106 and 114, with the associated endless belt 116, in the pump housing 22 permits the "thickness" of the pump housing, as measured in a direction perpendicular to the plane in which the belt 116 rotates, to be minimized. Thus the amount of space occupied by the pump housing 22 within the bathtub may, in turn, be minimized, and this, of course, is an extremely attractive feature from the standpoint of commercializing the improved hydrotherapy bath assembly of my present invention. In addition, by using the pulley and endless belt arrangement, the pumping chamber 122 can be designed and constructed so that the impeller shaft 120 may be horizontally disposed. This then permits the use of a readily accessible knob 184 to control the direction the water being discharged from the pumping chamber 122, and these features are also very important from the standpoint of successfully marketing the assembly 20.

The entire pump housing 22, motor housing 24 and the overhead support housing 26 may be molded as a unit of a Lexan or Cycolac material. Similarly, the cover 40 may also be molded from Lexan or a Cycolac material. The use of such plastic materials reduced the weight of the assembly 20 without significantly lessoning its durability.

The above-described arrangement of the shaft 90 and the pulleys 106 and 114, with the associated endless belt 116, also permits a smaller and thus lighter electric motor 66 to be used with the assembly 20 as compared with the motors used with prior hydrotherapy bath assemblies. Thus, it has been found that a one-twelfth (1/12) horsepower motor may be used and that the pumping chamber 122 can pump approximately 15 gallons per minute at between 3.75–4.0 p.s.i. This pumping rate compares favorably with the pumping rate (30 to 39 gallons per minute at approximately 4.75 p.s.i.) found in the prior, heavier bath assemblies such as disclosed in U.S. Pat. No. 3,961,382. The specific design and construction of the hydrotherapy bath assembly 20, as described above, together with the use of a smaller motor permits a commercial embodiment of the assembly 20 to weight approximately 8 pounds as compared to a weight of 20–28 pounds for other presently available hydrotherapy bath assemblies on the market.

While in the foregoing, there has been provided a detailed description of the particular embodiment of my present invention, it is to be understood that all equivalence obvious to those having skill in the art are to be included within the scope of the invention as claimed.

What is claim is:

1. An improved portable hydrotherapy bath assembly designed for mounting on the side wall of a conventional bathtub and for creating a relaxing, swirling or whirlpool effect in the water in the bathtub, the improved portable hydrotherapy bath assembly comprising:

a motor housing having an upper end and a lower end, and being adapted to be disposed on the outside of the bathtub adjacent to the side wall of the bathtub, with the upper end of the motor housing being positioned adjacent to the upper edge of the side wall of the bathtub;

a pump housing having an upper end, a lower end and a longitudinal axis that extends between its ends and being adapted to be disposed within the bathtub adjacent to the side wall of the bathtub, with the upper end of the pump housing being adapted to be disposed adjacent to the upper edge of the side wall of the bathtub and with the lower end of the pump housing being adapted to be immersed in the water in the bathtub;

an overhead support housing having a bottom wall, a first end, a second end and a longitudinal axis that extends between its ends and being adapted to be disposed so that its bottom wall rests on the upper edge of the side wall of the bathtub, with its first end being operatively connected with the upper end of the motor housing and with its second end being operatively connected with the upper end of the pump housing;

electric motor means mounted in the motor housing for operation therein and having a rotary motor output shaft, with the electric motor means being arranged within the motor housing so that the output shaft is adjacent to the first end of the overhead support housing and is substantially parallel to the longitudinal axis of the overhead support housing;

a second shaft having a first end and a second end and being mounted for rotation within the overhead support housing so that its longitudinal axis is substantially parallel to the longitudinal axis of the overhead support housing, with the first end of the second shaft being disposed adjacent to the first end of the overhead support housing and with the second end of the second shaft being disposed adjacent to the second end of the overhead support housing;

means for interconnecting the output shaft of the electric motor means with the first end of the second shaft so that the second shaft is rotated by rotation of the output shaft;

a pumping chamber in the lower end of the pump housing and including a impeller means which may be rotated within and cooperate with the pumping chamber so as to draw water into the pumping chamber from the bathtub and so as to discharge water under pressure from the pumping chamber into the bathtub, the impeller means having a rotary drive shaft, with the axis of rotation of the drive shaft of the impeller means being substantially perpendicular to the longitudinal axis of the pump housing;

and belt drive means for interconnecting the second end of the second shaft and the drive shaft of the impeller means for causing the impeller means to be rotated within the pumping chamber.

2. The improved portable hydrotherapy bath assembly described in claim 1 wherein means for securing the bath assembly on the side wall of the bathtub are mounted on the lower end of the motor housing and are selectively movable, with respect to the motor housing, into and out of contact with the adjacent outside surface of the side wall of the bath tub.

3. The improved portable hydrotherapy bath assembly described in claim 1 wherein the pumping chamber includes a first water discharge port and a second water discharge port, with the first and second discharge ports being adapted to discharge water under pressure in two different directions from the pumping chamber; and wherein valve means are associated with the pumping chamber for selectively controlling whether water is discharged through the first discharge port or the second discharge port.

4. The improved portable hydrotherapy bath assembly described in claim 3, wherein the valve means is mounted on the pumping chamber and may be rotated between a first position wherein water may be discharged through the first discharge port and a second position wherein water may be discharged through the second discharge port, with the axis of rotation of the valve means being coaxial with the longitudinal axis of the drive shaft of the impeller means.

5. The improved portable hydrotherapy bath assembly described in claim 1 wherein the belt drive means includes a first pulley on the second end of the second shaft, a second pulley on the drive shaft of the impeller means and and endless belt extending between and around the first and second pulley; and wherein the impeller means rotates in a plane that is substantially parallel to a plane including the longitudinal axis of the pump housing.

6. The improved portable hydrotherapy bath assembly described in claim 5 wherein the vertical plane which includes the endless belt is disposed adjacent to the wall of the pump housing chamber that contacts the side wall of the bathtub; and wherein the second shaft is journaled in bearings mounted on the bottom wall of the overhead support housing.

7. The improved portable hydrotherapy bath assembly described in claim 5 wherein the pumping chamber is mounted on the pumping housing side wall that is spaced and faces away from the side wall of the bathtub; and wherein the longitudinal axes of the output shaft of the electric motor means, of the second shaft and of the first pulley are coaxial and are substantially parallel to the longitudinal axis of the drive shaft of the impeller means.

8. The improved portable hydrotherapy bath assembly described in claim 1 wherein the interconnection means includes a relatively thin strip of non-electrically conductive, pliable material.

9. The improved portable hydrotherapy bath assembly described in claim 1 wherein the motor housing, the overhead support housing and the pump housing are molded as an integral unit, and have a cover member which is adapted to overlie and close the upper ends of these housings, with the cover member including a handle for facilitating the transportation of the bath assembly.

10. The improved portable hydrotherapy bath assembly described in claim 9 wherein electrical switch means are mounted in the cover and is operatively connected with the electric motor means so as to control the operation of the electric motor means.

* * * * *